US007591436B2

(12) United States Patent
Ganser

(10) Patent No.: US 7,591,436 B2
(45) Date of Patent: Sep. 22, 2009

(54) FUEL INJECTION VALVE FOR INTERNAL COMBUSTION ENGINES

(75) Inventor: Marco Ganser, Oberägeri (CH)

(73) Assignee: Ganser-Hydromag AG (CH)

( * ) Notice: Subject to any disclaimer, the term of this patent is extended or adjusted under 35 U.S.C. 154(b) by 257 days.

(21) Appl. No.: 11/509,595

(22) Filed: Aug. 25, 2006

(65) Prior Publication Data

US 2006/0278731 A1 Dec. 14, 2006

Related U.S. Application Data

(63) Continuation-in-part of application No. PCT/CH2005/000098, filed on Feb. 21, 2005.

(30) Foreign Application Priority Data

Feb. 25, 2004 (CH) ..... 0310/04

(51) Int. Cl.
*F02M 41/16* (2006.01)
*F02M 61/20* (2006.01)
*F02M 51/06* (2006.01)
*F02M 51/00* (2006.01)

(52) U.S. Cl. ..... 239/96; 239/533.9; 239/585.1

(58) Field of Classification Search ..... 239/96, 239/533.2–533.9, 585.1, 88, 89, 585.2
See application file for complete search history.

(56) References Cited

U.S. PATENT DOCUMENTS 4,798,186 A * 1/1989 Ganser ..... 123/467
4,826,080 A * 5/1989 Ganser ..... 239/88
4,838,231 A * 6/1989 Ganser ..... 123/467
4,946,103 A * 8/1990 Ganser ..... 239/88
5,458,293 A * 10/1995 Ganser ..... 239/533.8
5,577,667 A * 11/1996 Ganser ..... 239/533.8
5,651,503 A * 7/1997 Ricco ..... 239/533.4
5,655,716 A * 8/1997 Mathis ..... 239/533.8
5,685,483 A 11/1997 Ganser
5,694,903 A * 12/1997 Ganser ..... 123/496
5,775,301 A 7/1998 Ganser (Continued)

FOREIGN PATENT DOCUMENTS

DE 101 52 428 5/2003

(Continued)

OTHER PUBLICATIONS

PCT/CH2005/000098 English language translation of International Preliminary Report on Patentability.

(Continued)

*Primary Examiner*—Darren W Gorman
(74) *Attorney, Agent, or Firm*—Hershkovitz & Associates, LLC; Abraham Hershkovitz

(57) ABSTRACT

The movement of an injection valve member, which can be longitudinally displaced and guided in a housing and which is used to close and release injection openings, is controlled of a hydraulic control device which comprises a control body which is maintained in a central bore on the periphery thereof and which is provided with a control duct which is connected to a control area on a lower front-surface side of the control body and which is sealed on another upper front-surface side of the control body and which can be connected to a low pressure area by a pilot valve.

17 Claims, 4 Drawing Sheets

U.S. PATENT DOCUMENTS

Figure 1:
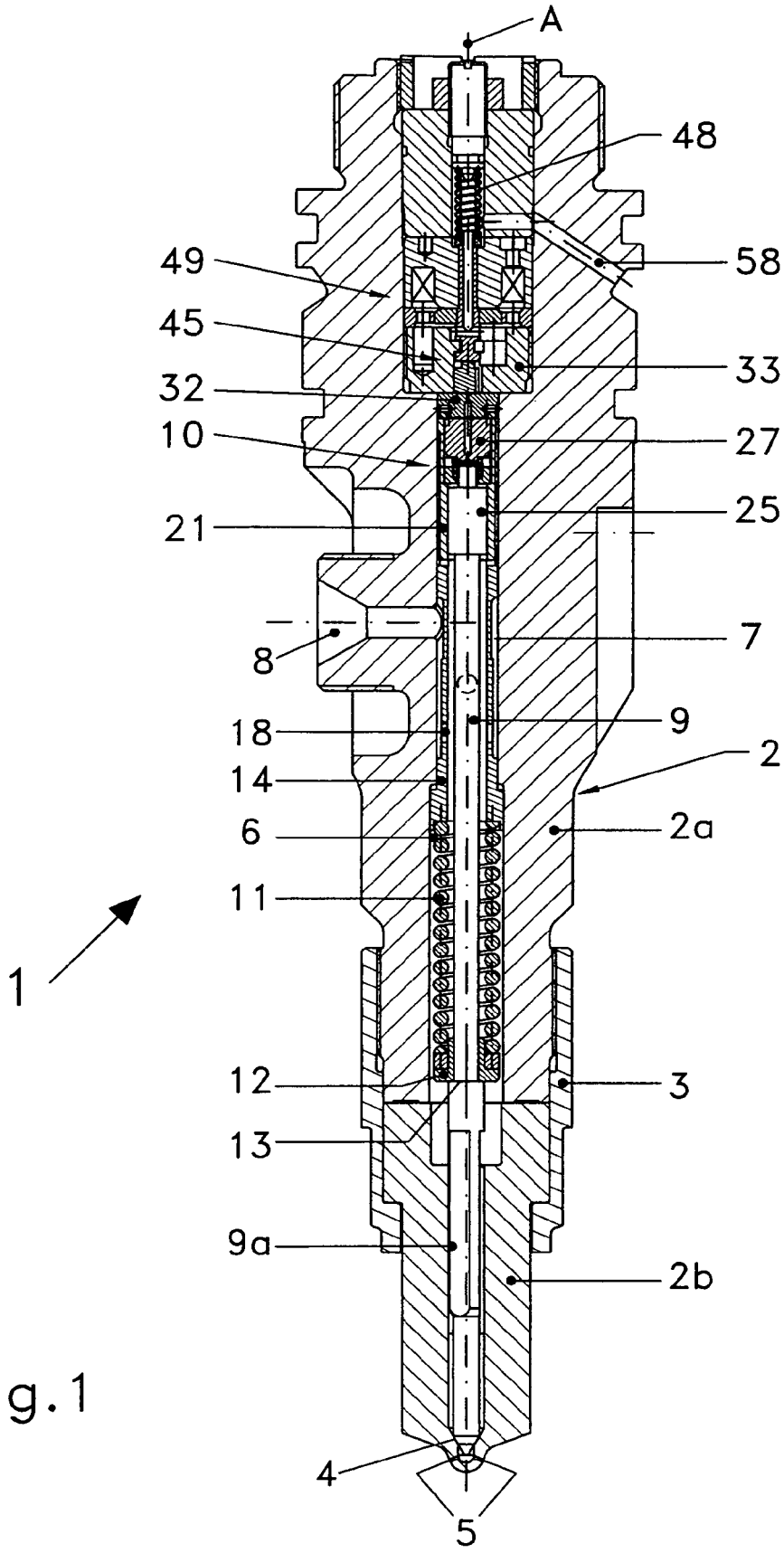

| | | | | |
|---|---|---|---|---|
| 5,842,640 | A | 12/1998 | Ganser | |
| 6,293,254 | B1 | 9/2001 | Crofts et al. | |
| 6,405,941 | B2 * | 6/2002 | Ganser | 239/88 |
| 6,409,094 | B2 * | 6/2002 | Tojo et al. | 239/5 |
| 6,499,669 | B2 * | 12/2002 | Ganser | 239/96 |
| 6,726,128 | B2 * | 4/2004 | Schempp | 239/533.2 |
| 6,810,857 | B2 * | 11/2004 | Boehland et al. | 123/467 |
| 6,892,967 | B2 * | 5/2005 | Tappolet et al. | 239/533.2 |
| 6,994,273 | B2 * | 2/2006 | Ganser et al. | 239/96 |
| 7,108,491 | B2 * | 9/2006 | Ganser | 417/470 |
| 2001/0013556 | A1 | 8/2001 | Ganser | |
| 2003/0052198 | A1 | 3/2003 | Tappolet et al. | |
| 2003/0132410 | A1 | 7/2003 | Stoecklein et al. | |
| 2003/0168527 | A1 | 9/2003 | Stoecklein et al. | |
| 2004/0025842 | A1 | 2/2004 | Boecking | |

FOREIGN PATENT DOCUMENTS

| | | |
|---|---|---|
| EP | 0 426 205 | 7/1993 |
| EP | 1 273 791 | 1/2003 |
| WO | WO 02/40855 | 5/2002 |
| WO | WO 02/084106 | 10/2002 |
| WO | WO 03/071122 | 8/2003 |
| WO | WO 03/095825 | 11/2003 |

OTHER PUBLICATIONS

PCT/CH2005/000098 International Search Report, Mar. 31, 2005.

* cited by examiner

FUEL INJECTION VALVE FOR INTERNAL COMBUSTION ENGINES

The present application is a continuation-in-part of application PCT/CH2005/000098, filed on Feb. 21, 2005, and published as WO 2005/080785 A1, that claims priority under 35 U.S.C. §119 to Swiss application 310/04, filed on Feb. 25, 2004, the disclosures of each of which are expressly incorporated by reference herein in their entireties.

The present invention relates to a fuel injection valve for the intermittent injection of fuel into the combustion chamber of an internal combustion engine.

EP-A-1 273 791 has disclosed a fuel injection valve of this type, in which the control body is seated fixedly in a housing hole by means of a shrink joint and therefore seals the low pressure space with respect to the high pressure space. This is also true of the fuel injection valve which is disclosed in EP-B-0 426 205. Pressing the control body into the housing hole requires a certain amount of expenditure on assembly technology.

WO-A-03/095825 discloses an injector for the injection of fuel, in which an annular gap is formed between an injector body and a throttle module which is inserted into the former and is configured as a separate component. In order to seal this annular gap, plastically deformable cutting edges are provided on the throttle module, which are pressed against steps in the injector housing during the assembly of the throttle module. In the fuel injection valve which is described in WO-A-02/084106 and is not of the same generic type, a control space is delimited on one side by a spring collar which is arranged loosely, that is to say not in a sealing manner, in a hole of a nozzle body. Said spring collar is pressed against a corresponding body by the pressure which prevails in the high pressure space of the valve and by the force of a spring.

The present invention is based then on the object of providing a fuel injection valve of the type which is mentioned in the introduction, in which the manufacture and installation of the control body into the housing is simpler and therefore less expensive than the known fuel injection valves.

According to the invention, this object is achieved with a fuel injection valve having the features of claim 1.

The control body is no longer pressed into the housing, as in the prior art, but is inserted loosely and not in a sealing manner into the opening in the housing. This makes simple installation and dismantling of the control body possible. Furthermore, the control body can be manufactured more inexpensively, as requirements which are not so high have to be placed on the dimensional accuracy and the machining quality.

The sealing of the high pressure space with respect to the low pressure space is ensured firstly by the interaction of sealing faces on the control body and on the holding body and secondly by a further sealing face on the holding body bearing against a seat face which is configured on the housing.

Preferred refinements of the fuel injection valve according to the invention are described in the dependent claims.

Figure 2:
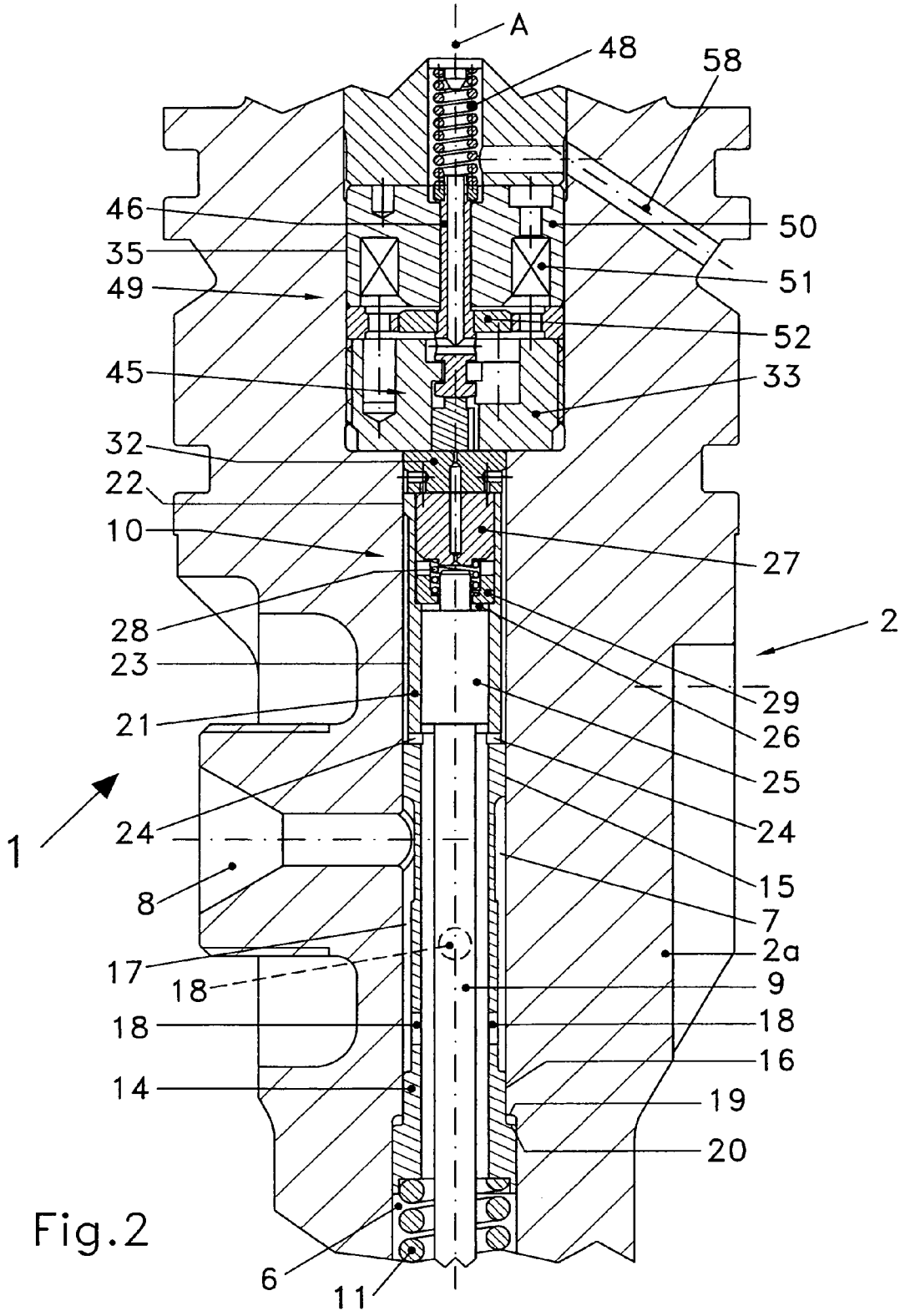
Figure 3:
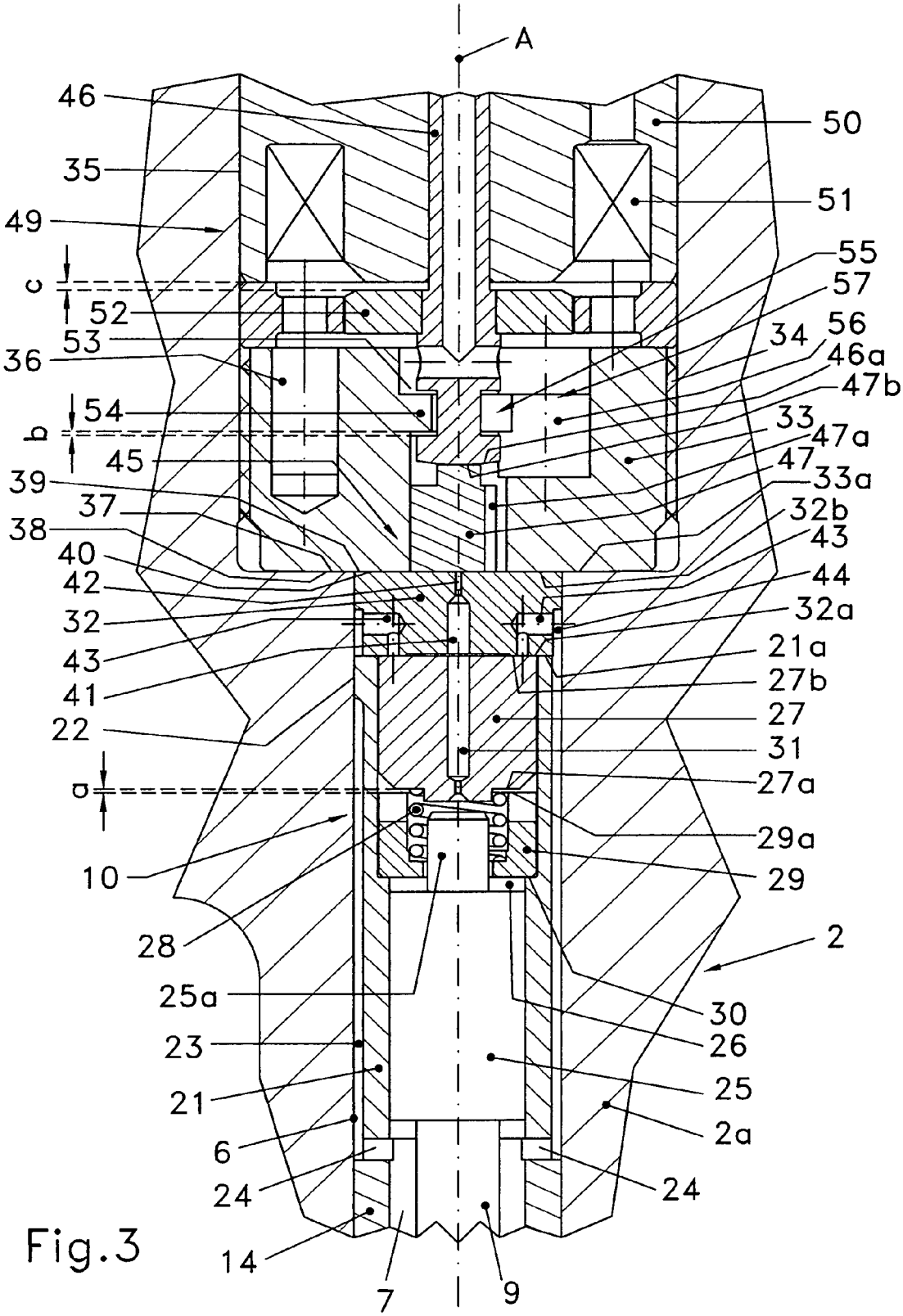
Figure 4:
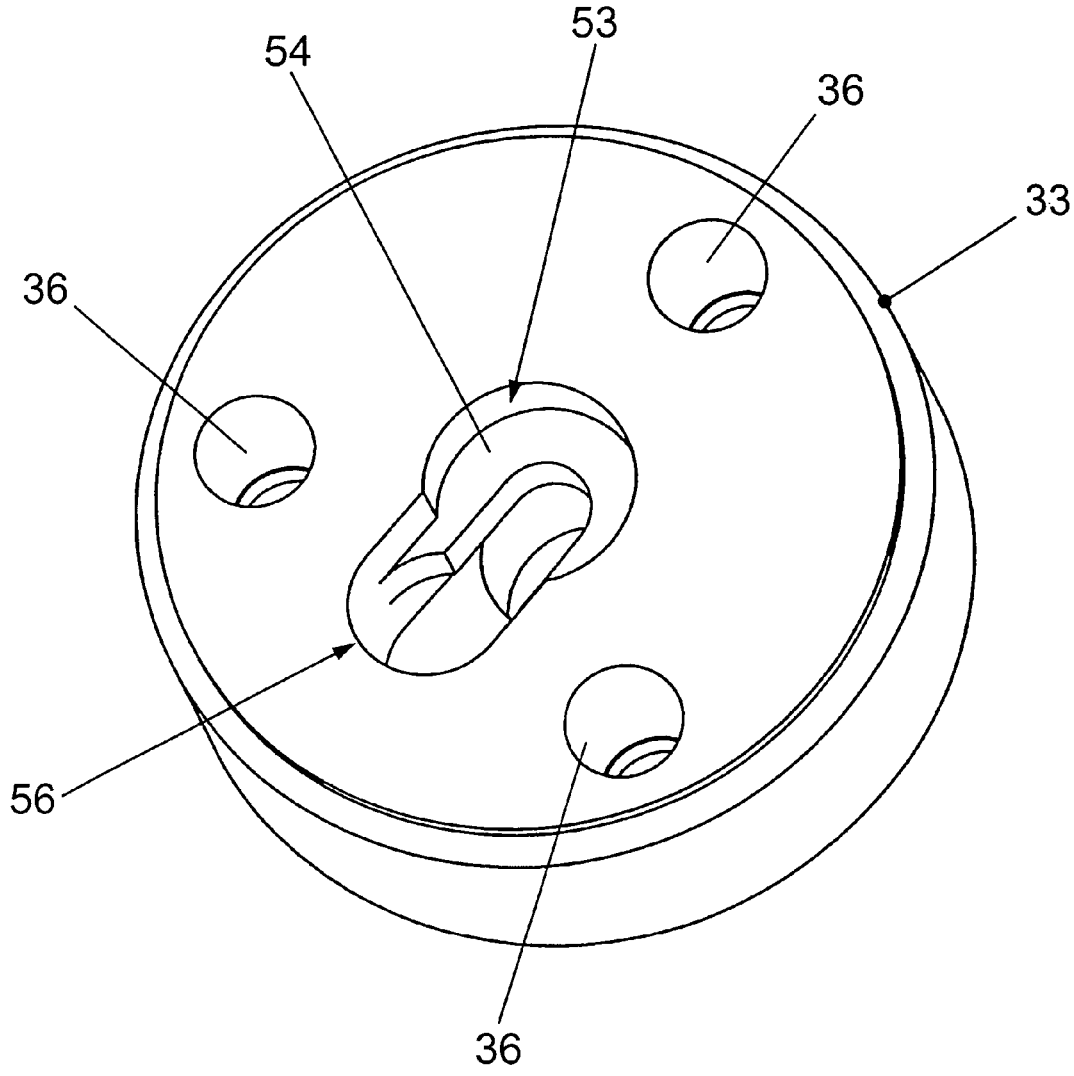

In the following text, one exemplary embodiment of the subject matter of the invention will be explained in greater detail with reference to the figures, in which, purely diagrammatically:

FIG. 1 shows a fuel injection valve in longitudinal section,

FIG. 2 shows a part region of the fuel injection valve according to FIG. 1 in longitudinal section and on an increased scale compared with FIG. 1, FIG. 3 shows a part region of the illustration according to FIG. 2 in longitudinal section and on an increased scale compared with FIG. 2, and FIG. 4 shows the holding body of the fuel injection valve which is shown in FIGS. 1 to 3, in a perspective illustration.

The fuel injection valve 1 which is shown diagrammatically in longitudinal section in FIG. 1 has a housing 2 which is formed by an upper housing part 2*a* and a valve seat element 2*b*. The valve seat element 2*b* is connected in a sealing manner to the upper housing part 2 *a*by means of a holding element 3 which is configured as a clamping nut.

The valve seat element 2*b* has a valve seat 4 and injection openings 5. A central hole 6 which is coaxial with respect to the longitudinal axis A of the housing 2, has a diameter which changes over its length and defines a high pressure space 7 configured in the interior of the housing 2. Said high pressure space 7 is connected to a high pressure fuel inlet 8 and extends as far as the valve seat 4.

An injection valve element 9 which is configured as a valve needle and is coaxial with respect to the housing longitudinal axis A is arranged in the interior of the housing 2, that is to say in the hole 6, which injection valve element 9 interacts by way of its tip with the valve seat 4 in the closed position which is shown in FIG. 1, in order to close the injection openings 5. In order to open the injection openings 5, the injection valve element 9 is raised from the valve seat 4 by means of a hydraulic control apparatus 10, the construction of which will be explained in greater detail using FIGS. 2 and 3. The injection valve element 9 is guided in the valve seat element 2*b* by way of a part piece which is configured as a guide 9*a*, by means of a tight sliding fit. In order to ensure a hydraulic connection, the injection valve element 9 is provided with ground-down faces in the region of this guide 9*a*. The injection valve element 9 is pressed downward in the closing direction by means of a closing spring 11. At its lower end, the closing spring 11 is supported on a supporting ring 12 which rests on a shoulder 13 on the injection valve element 9. At the other end, the closing spring 11 is supported on a spacer sleeve 14 which surrounds the injection valve element 9.

The relatively long, hollow cylindrical spacer sleeve 14 bridges the region of the opening of the high pressure fuel inlet 8 into the central hole 6 and is guided at its ends on the wall of the hole 6 by means of guide faces 15, 16 (FIG. 2). Here, the play between the guide face 15, 16 and the wall of the hole 6 is between 1/100 and 1/10 mm. Between its ends which are provided with the guide faces 15, 16, the spacer sleeve 14 has a smaller diameter, with the result that an annular space 17 is formed between the wall of the hole 6 and the outer circumference of the spacer sleeve, which annular space 17 is connected to the high pressure fuel inlet 8. The spacer sleeve 14 is provided with passage openings 18, through which fuel can pass from the annular space 17 into the interior of the spacer sleeve 14.

A stop shoulder 19 is configured in the housing 2, which stop shoulder 19 serves as a stop for the spacer sleeve 14 during a displacement of the latter in the upward direction and is intended to interact with a stop face 20 which is configured on the lower end of the spacer sleeve 14 (FIG. 2). At its upper end, the spacer sleeve 14 presses against a hollow cylindrical guide sleeve 21 which belongs to the hydraulic control apparatus 10 and is guided at the upper end in the central hole 6 by means of a guide face 22. There is an annular space 23 between the guide sleeve 21 and the wall of the hole 6, which annular space 23 is connected to the interior of the spacer sleeve 14 via passages 24, which are provided at the lower end of the guide sleeve 21 or at the upper end of the spacer sleeve 14, and belongs to the high pressure space 7.

In the following text, further elements of the hydraulic control apparatus 10 will be described with reference to FIGS. 2 and 3.

At its end which lies opposite the valve seat 4, the injection valve element 9 has a double action control piston 25 which is guided in the guide sleeve 21 with a tight sliding fit. The control piston 25 is loaded on its underside by the high fuel pressure in the high pressure space 7 and with its upper side delimits a control space 26 which is delimited laterally by the guide sleeve 21. An intermediate valve body 27 is situated in the guide sleeve 21, which intermediate valve body 27 can be displaced in the direction of the longitudinal axis A and has a lower end side 27*a*. The intermediate valve body 27 is guided in the guide sleeve 21 with a play of typically from 0.03 to 0.2 millimeters. A throttle passage 31 which is coaxial with respect to the longitudinal axis A and extends between the lower and upper end sides 27*a*, 27*b* of the intermediate valve body 27 extends in the intermediate valve body 27.

A spring element 28 is arranged in the control space 26, which spring element 28 is supported on one side on the intermediate valve body 27 and on the other side on a supporting element 29 which rests on an annular shoulder 30 on the guide sleeve 21 (FIG. 3). The spring element 28 surrounds a central projection 25*a* of the control piston 25 and generates a force on the intermediate valve body 27, which force is substantially smaller than the force which is exerted by the closing spring 11. When the injection valve 1 is closed, the lower end side 27*a* of the intermediate valve body 27 is arranged at a spacing a from the upper side 29*a* of the supporting element 29 (see FIG. 3). The supporting element 29 serves as a stop which limits the movement of the intermediate valve body 27 downward. The supporting element 29 could also be of one piece with the guide sleeve 21 and configured as one workpiece with the latter.

The intermediate valve body 27 bears with the upper end side 27*b* against a lower end side 32*a*, which serves as a sealing face, of a control body 32 which is arranged loosely, that is to say not in a sealing manner, in the central hole 6. Together with the upper side 21*a* of the guide sleeve 21, the lower end side 32*a* of the control body 32 seals the control space 26 with respect to the high pressure space 7. The control body 32 bears with an upper end side 32*b* against the underside 33*a* of a holding body 33. The holding body 33 is screwed into a recess 35 in the housing 2 by means of an external thread 34. The holding body 33 is provided with countersunk holes 36 which serve to introduce a tool for screwing and tightening the holding body 33 (see also FIG. 4).

The holding body 33 is screwed fixedly into the housing recess 35 in such a way that it bears with a first annular sealing face 37 which is configured on its underside 33*a* against a seat face 38 which is configured on the base of the recess 35 in the housing 2 and surrounds the central hole 6. A second, likewise annular sealing face 39 adjoins said first sealing face 37 of the holding body 33, which second sealing face 39 lies in the same plane as the first sealing face 37. A sealing face 40 which is configured on the upper end side 32*b* of the control body 32 bears against said second sealing face 39. The sealing faces 37, 38, 39 and 40 preferably seal close to the circumference of the hole 6. Here, the sealing faces 37 and 39 of the holding body 33 are advantageously configured on a single flat end face of the holding body 33.

The control body 32 has a continuous control passage 41 which extends coaxially with respect to the longitudinal direction A and has a throttle restriction 42 at its end which opens into the upper end face 32*b* of the control body 32. The control passage 41 is hydraulically connected to the throttle passage 31 in the intermediate valve body 27.

The sealing face 40 on the upper end side 32*b* of the control body 32 surrounds the control passage 41.

Further passages 43 are formed in the control body 32, which passages 43 are offset laterally with respect to the control passage 41 and open into the lower end side 32*a* of the control body 32. At the other end, the passages 43 are connected to an annular groove 44 on the outer circumference of the control body 32, which annular groove 44 is connected to the annular space 23 and in which therefore the high fuel pressure prevails. In the injection valve 1 which is situated in the closed position, that is to say therefore between the injection processes, the passages 43 are closed by the intermediate valve body 27 which is pressed with its upper end side 27*b* against the lower end side 32*a* of the control body 32.

In order to control the movement of the injection valve element 9, an electromagnetically actuated pilot valve 45 is accommodated in the housing 2, which pilot valve 45 has a displaceable valve stem 46 and a closure body 47 which is separate from the former and rests between injection processes on that upper end side 32*b* of the control body 32 which serves as a valve seat face, and closes the control passage 41. A pilot valve spring 48 which presses the closure body 47 against the upper end side 32*b* of the control body 32 acts on the valve stem 46 and therefore also on the closure body 47.

In order to actuate the valve stem 46, there is an electromagnet arrangement 49 which comprises a magnet body 50 having a magnet coil 51 and a magnet armature 52. The valve stem 46 is connected fixedly to the magnet armature 52 and is guided displaceably in the magnet body 50.

In addition to the countersunk holes 36, the holding body 33 also has a central hole 53 (see also FIG. 4), in which the valve stem 46 extends and in which the closure body 47 is guided displaceably. A stop shoulder 54 which engages into an annular groove 55 on the valve stem 46 protrudes into said central hole 53. The stop shoulder 54 serves to limit the stroke of the valve stem 46 during an excitation of the electromagnet arrangement 49. Here, the maximum possible stroke b of the valve stem 46 is smaller than the spacing c between the magnet armature 52 and the magnet body 50, with the result that the magnet armature 52 does not bear against the magnet body 50, even when the pilot valve 45 is open. The stop shoulder 54 for the valve stem 46 lies outside the effective magnetic field of the electromagnet arrangement 49.

In order for it to be possible to insert the valve stem 46 into the holding body 33, the latter is provided with an eccentrically arranged recess 56 which is open toward the central hole 53. The valve stem 46 is introduced into the recess 56 in a manner which is offset laterally with respect to the axis of the central hole 53. If the annular groove 55 of the valve stem 46 is situated at the level of the stop shoulder 54, the valve stem 46 is displaced in the transverse direction into the central hole 53.

In addition to closing the control passage 41, the closure body 47 which is guided loosely in the hole 53 serves to set the stroke b of the valve stem 46 accurately. The magnitude of the stroke b can be fixed accurately by the use of a closure body 47 having a defined height. If accurate setting of this type should not be necessary, which can be the case, for example, in another refinement of the stroke limitation of the valve stem 46, the closure body 47 can be omitted. In this case, the control passage 41 is closed directly by the valve stem 46, as is known, for example, from EP-A-1 273 791. In the solution which is shown in the figures, the lower, spherical end 46*a* of the valve stem 46 acts on the flat upper end face 47*b* of the closure body 47 (FIG. 3). In the opposite case, the upper end face 47*b* of the closure body 47 could be of spherical configuration and interact with a flat end face 46*a* of the valve stem 46. In both cases, the sealing action of the pilot valve 45 is improved.

The central hole 53 and the recess 56 in the holding body 33 belong to a low pressure space 57 which is flow-connected to a low pressure outlet 58 (FIGS. 1 and 2). A line (not shown) leads back to a fuel reservoir from this low pressure outlet 58. The closure body 47 is provided with longitudinal grooves 47*a* which permit a throughflow of fuel from the control passage 41 into the low pressure space 57 when the closure body 47 is raised by the control body 32.

As has already been mentioned, the high fuel pressure which can be 2000 bar and more prevails in the annular groove 44 in the control body 32. In order to prevent it being possible for relatively great amounts of fuel to pass from this annular groove 44 which belongs to the high pressure space 7 to the low pressure space 57 past the control body 32 which is inserted into the housing 2 not in a sealing manner, the first sealing face 37 of the holding body 33 which is screwed into the housing 2 is pressed in a sealing manner against the seat face 38 in the housing 2. Furthermore, the control body 32 is pressed by the fuel pressure in the high pressure space 7 with its sealing face 40 against the other sealing face 39 on the holding body 33. Here, requirements which are not excessively high are made on the surface quality of the sealing faces 37, 39 and 40 and the seat face 38. It can be sufficient to grind these faces, in order to achieve a satisfactory sealing action, because the sealing action does not have to be 100%. Expensive post-machining steps are therefore not necessarily required. If a 100% sealing action should be necessary or desired, it can be achieved with finely lapped faces. However, if the leakage is substantially smaller than the amount of fuel which is relieved via the control passage 41 (for example, 10% of the latter or less), the leakage does not play a role in practice as a rule.

The method of operation of the fuel injection valve 1 which is shown in FIGS. 1 to 3 is as follows: the starting point is the state which is shown in these figures, in which the injection valve element 9 is situated in the closed position and the intermediate valve body 27 bears sealingly against the control body 32. The electromagnet arrangement 49 is not excited and the closure body 47 closes the control passage 41. The same pressure prevails in the control space 26 as in the high pressure space 7.

An injection cycle is triggered by the excitation of the electromagnet arrangement 49. Here, the magnet armature 52 is pulled against the magnet body 50, which has the consequence that the valve stem 46 is raised from the closure body 47. The closure body 47 can then be displaced upward under the action of the fuel pressure in the control passage 41 and opens the control passage 41. The control passage 41 and therefore also the control space 26 are now connected to the low pressure space 57. The pressure in the control space 26 begins to drop. As a result, the injection valve element 9 moves away from the valve seat 4 and opens the injection openings 5. The injection process begins. Here, fuel is displaced out of the control space 26 through the throttle passage 31 and the control passage 41 into the low pressure space 57. During the entire opening process of the injection valve element 9, the intermediate valve body 27 remains in contact with the control body 32. The opening stroke of the injection valve element 9 is limited, for example, by the fact that the projection 25*a* of the control piston 25 comes into contact with the intermediate valve body 27.

In order to end the injection process, the electromagnet arrangement 49 is de-energized. This has the consequence that, under the force of the pilot valve spring 48, the valve stem 46 and, together with it, the closure body 47 are moved downward, until the closure body 47 comes into contact with the control body 32. The low-pressure-side opening of the control passage 41 is closed again by the closure body 47. The pressure in the control passage 41 begins to rise. Together with the circumstance that the high fuel pressure prevails in the passages 43 in the control body 32, this leads to the intermediate valve body 27 moving away from the sealing contact with the control body 32. The downward movement of the intermediate valve body 27 is ended by stops on the upper side 29*a* of the supporting element 29. As a result of the fact that the passages 43 in the control body 32 are opened by the movement of the intermediate valve body 27 away from the control body 32, fuel can flow under high pressure through these passages 43 and the throttle passage 31 and along the entire circumference of the intermediate valve body 27, which accelerates the closing process of the injection valve element 9 to a pronounced extent. As soon as the injection valve element 9 bears against the valve seat 4 again and closes the injection openings 5, the injection process is ended.

Immediately after this, the intermediate valve body 27 is moved back into its sealing position under the force of the spring element 28. The fuel injection element 1 is then ready for the next injection process.

The spacer sleeve 14 which bridges the region of the high pressure fuel inlet 8 makes it possible to arrange the closing spring 11 below the high pressure fuel inlet 8, with the result that the wall thickness of the housing 2 can be kept great in the region of the high pressure fuel inlet 8, without it being necessary to increase the external diameter of the housing 2. The spacer sleeve 14 transmits the force of the closing spring 11 to the control body 32 via the guide sleeve 21.

During assembly, the injection valve element 9, together with the closing spring 11 and the spacer sleeve 14 which is pushed over it, is inserted into the valve seat element 2*b*, this subassembly is introduced into the upper housing part 2*a* and is fastened by means of the holding element 3 to the upper housing part 2*a*. The stop shoulder 19 in the upper housing part 2*a* limits the insertion path of the spacer sleeve 14 in the central hole 6, which makes the assembly of the control body 32 considerably simpler.

As mentioned, the supporting element 29 serves as a stop for the intermediate valve body 27, as a result of which the opening path of the intermediate valve body 27 is limited. This affords advantages during preinjections at short time intervals.

As a result of the fact that the control body 32 is inserted loosely into the central hole 6, no particular requirements have to be made of the control body 32 with regard to manufacture and machining. In addition, the installation of the control body 32 into the housing 2 is comparatively simple. This all has a favorable effect on the costs.

In the exemplary embodiment shown, the fuel is fed to the valve seat 4 via the central housing hole 6. However, the special structural solutions which are described can also be used in fuel injection valves, in which the fuel is fed to the valve seat via a feed channel which is offset laterally with respect to the housing longitudinal axis A, as is known, for example, from U.S. Pat. No. 5,775,301.

The invention claimed is:

1. A fuel injection valve for intermittent injection of fuel into a combustion chamber of an internal combustion engine, the fuel injection valve comprising:

an elongated housing;

a valve seat with injection openings;

a high pressure space in the housing which is connected to a high pressure fuel inlet and to the valve seat;

an injection valve element which is guided in the housing in a longitudinally adjustable manner and interacts with the valve seat for closing and opening the injection openings; and a hydraulic control apparatus for controlling the adjusting movement of the injection valve element, wherein the hydraulic control apparatus has a control body which is held on its circumference in an opening in the housing, wherein the opening is connected to the high pressure space, said control body being provided with a control passage which, on a first end side of the control body, is connected to a control space and, on a second end side of the control body, is closed and is connectable to a low pressure space by means of a pilot valve, wherein the control body is held on its circumference in a non-sealing manner in the opening of the housing and has a flat sealing face on its second end side, wherein the flat sealing face surrounds the control passage, the control body sealingly engaging said flat sealing face, under action of fuel pressure in the high pressure space, against a first sealing face of a holding body which is held fixedly in the housing and on which a second sealing face is formed which lies in a common flat end face with the first sealing face on the holding body and with which the holding body sealingly engages a seat face which is formed in the housing and surrounds the opening in the housing.

2. The fuel injection valve of claim 1, wherein the hydraulic control apparatus has a control piston which is guided in a longitudinally displaceable manner is operatively connected to the injection valve element and is loaded firstly by fuel system pressure which prevails in the high pressure space and secondly by fuel control pressure in the control space.

3. The fuel injection valve of claim 1, wherein a displaceable intermediate valve body is arranged in the opening in the housing, wherein the displaceable intermediate valve body bears against the first end side of the control body in the closed state of the fuel injection valve and thereby closes at least one passage which is formed in the control body and opens firstly into the first end side of the control body and secondly is flow-connected to the high pressure space.

4. The fuel injection valve of claim 3, wherein a stop is provided in the housing for limiting displacement movement of the intermediate valve body.

5. The fuel injection valve of claim 3, wherein the intermediate valve body is guided with play in a guide sleeve which is arranged in the opening in the housing and bears against the first end side of the control body.

6. The fuel injection valve of claim 5, wherein the stop is formed on the guide sleeve.

7. The fuel injection valve of claim 4, wherein the stop is formed on a supporting element which is supported in the guide sleeve and serves as a rest for a spring element which presses the intermediate valve body against the control body.

8. The fuel injection valve of claim 5, wherein a spacer sleeve which is arranged in the opening in the housing, surrounds the injection valve element, and on which a closing spring is supported with its one end, wherein the closing spring is supported on the injection valve element with its other end.

9. The fuel injection valve of claim 8, wherein the spacer sleeve bears against the guide sleeve at that end of the latter which faces away from the control body.

10. The fuel injection valve of claim 1, wherein the pilot valve has a valve stem which extends in the holding body and, when an electromagnet arrangement is excited for opening the control passage, can be moved in the direction away from the control passage counter to a force of a pilot valve spring, the opening stroke of the valve stem being limited by means of a stop which is formed in the holding body.

11. The fuel injection valve of claim 10, wherein the valve stem is connected to a magnet armature which interacts with a magnet coil, and the stop is arranged on a side of the magnet armature which faces away from the magnet coil.

12. The fuel injection valve of claim 10, wherein the stop is formed on the holding body.

13. The fuel injection valve of claim 12, wherein the stop is formed by a stop shoulder which is formed on the holding body and engages with axial play into a groove of the valve stem.

14. The fuel injection valve of claim 10, wherein a closure body which is guided loosely in the holding body is arranged between the valve stem and the control body, wherein the closure body is pressed by the valve stem against the second end side of the control body when the electromagnet arrangement is not excited and thereby closes the control passage.

15. The fuel injection valve of claim 14, wherein the closure body and an end of the valve stem which interacts with the former are arranged coaxially with respect to a longitudinal axis of the housing.

16. The fuel injection valve of claim 1, wherein the holding body is screwed into a recess in the housing.

17. The fuel injection valve of claim 1, wherein at least one passage is formed in the control body, wherein the at least one passage firstly opens into the first end side of the control body and secondly is connected to a recess which is formed on an outer circumference of the control body and is flow-connected to the high pressure space.

* * * * *